US006648436B2

(12) United States Patent
Maeda

(10) Patent No.: US 6,648,436 B2
(45) Date of Patent: Nov. 18, 2003

(54) REMAINING INK LEVEL DETECTION METHOD AND INKJET PRINTING APPARATUS

(75) Inventor: Masao Maeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/206,091

(22) Filed: Jul. 29, 2002

(65) Prior Publication Data

US 2003/0025741 A1 Feb. 6, 2003

(30) Foreign Application Priority Data

Jul. 31, 2001 (JP) ..... 2001-232919

(51) Int. Cl.[7] ..... B41J 2/195
(52) U.S. Cl. ..... 347/7
(58) Field of Search ..... 347/7, 19, 23, 347/5, 15, 6, 20, 85, 95, 100, 84

(56) References Cited

U.S. PATENT DOCUMENTS 6,428,132 B1 * 8/2002 Kubatzki et al.

OTHER PUBLICATIONS

U.S. patent application Ser. No. 10/206,092, filed Jul. 29, 2002 (Atty. Docket No. 01272.020538).

U.S. patent application Ser. No. 10/206,093, filed Jul. 29, 2002 (Atty. Docket No. 01272.020540).

* cited by examiner

*Primary Examiner*—Raquel Yvette Gordon
(74) *Attorney, Agent, or Firm*—Fitzpatrick, Cella, Harper & Scinto

(57) ABSTRACT

In inkjet printers, it becomes possible to precisely estimate a remaining ink level in detailed scales with a low-cost and simple structure using a sensor. Specifically, a relatively inexpensive sensor that can examine whether the remaining ink level is below a predetermined value or not is employed in combination with a counter (C2) that retains information about ink consumption in printing and other operations. When the sensor has detected an absence of ink in which ink level is below the predetermined level and it is judged that the sensor has detect a presence of ink, the value of the counter (C2) is made a threshold value (T2) corresponding to a level (N) at which the sensor detects the absence of ink and then this threshold value is used to determine the remaining ink level (L).

19 Claims, 12 Drawing Sheets

REMAINING INK LEVEL DETECTION METHOD AND INKJET PRINTING APPARATUS

This application is based on Patent Application No. 2001-232919 filed Jul. 31, 2001 in Japan, the content of which is incorporated hereinto by reference.

BACKGROUND OF THE INVENTION

1. Field of the Invention

The invention relates to inkjet printing apparatuses and methods for detecting the amount of remaining ink in the inkjet printing apparatuses, and particularly, to a method for detecting remaining ink level.

2. Description of the Related Art

Some of the conventional printing apparatuses such as inkjet printers, which use ink for printing, execute detecting of the remaining ink level so as to stop a printing operation or to provide an indication urging users to exchange the ink tank, when ink has run out or the ink level has become as low as to cause problems in printing. As methods for detecting ink levels, there have been proposed a variety of methods. For example, sensors are known as those directly detect the presence/absence of ink or a remaining level of ink, such as optical sensors utilizing a light interception by ink, electric sensors utilizing electric resistance change due to the presence/absence of ink, and mechanical sensors utilizing a lever that moves together with the ups and downs of the ink level. There is also a method that accumulates data about ink consumption during operations such as printing and recovering and then estimates the remaining level based on the accumulated data.

It is possible to check if the remaining ink level has fallen below a predetermined level by the use of such optical, electric and mechanical sensors of relatively simple structure and low cost. These sensors, however, have such disadvantages that the control process becomes complex and additional cost arises from detection components when estimating the remaining ink level in detailed scales.

On the other hand, the method for estimating the remaining ink level based on the accumulated data of ink consumption has the advantage of being capable of estimating the remaining ink level in detailed scales at relatively low cost. However, there are variations in the estimate of ink consumption due to variations in the ejection quantity and performance of the recovering mechanism. In addition, the capacity of the ink tank and the amount of filled ink may also vary. As a result, the estimated remaining ink level may significantly differ from the actual ink level. Further, it is also necessary to introduce some margin in the estimate of ink levels, taking such errors into account. Then, in turn, such a problem arises that the printing is stopped or the indication of ink-out is issued although the ink tank still has ink.

SUMMARY OF THE INVENTION

The object of the present invention is to provide an inkjet printing apparatus and a remaining ink level detection method that detect the remaining ink level precisely in detailed scales with a low-cost and simple structure using a sensor.

In the first aspect of the present invention, there is provided a remaining amount detecting method of detecting an amount of remaining ink in an ink reservoir, comprising the steps of:

providing sensing means for detecting whether the amount of remaining ink in the reservoir is below a predetermined level or not, detection state memory means for storing a state that the sensing means detects that the amount of remaining ink is below the predetermined level or a state that the amount of remaining ink is not below the predetermined level, and calculation means for calculating ink consumption in the ink reservoir based on an operation of means using the ink; and determining the amount of remaining ink on the predetermined level basis by using an ink consumption calculated by the calculation means and a threshold value as the ink consumption that is calculated by the calculation means and then supposed to reach the predetermined level for the sensing means;

wherein when the sensing means detects that the amount is below the predetermined level and the detection state stored in the detection state memory means is that the amount of remaining ink is not below the predetermined level, the ink consumption calculated by the calculation means is made a content of the threshold value.

In the second aspect of the present invention, there is provided an inkjet printing apparatus using a printing head for ejecting ink and an ink reservoir for storing ink supplied to the printing head to perform printing on a printing medium, and detecting an amount of remaining ink in the ink reservoir, the apparatus comprising:

sensing means for detecting whether the amount of remaining ink in the reservoir is below a predetermined level or not;

detection state memory means for storing a state that the sensing means detects that the amount of remaining ink is below the predetermined level or a state that the amount of remaining ink is not below the predetermined level;

calculation means for calculating ink consumption in the ink reservoir based on an operation of means using the ink; and determining the amount of remaining ink on the predetermined level basis by using an ink consumption calculated by the calculation means and a threshold value as the ink consumption that is calculated by the calculation means and then supposed to reach the predetermined level for the sensing means;

wherein when the sensing means detects that the amount is below the predetermined level and the detection state stored in the detection state memory means is that the amount of remaining ink is not below the predetermined level, the ink consumption calculated by the calculation means is made a content of the threshold value.

According to the above configuration, in determining a remaining amount of ink, when the sensing means detects that the remaining amount is equal to or less than a predetermined level and the state stored in the detection condition memory means indicates a state that the remaining amount is not equal to or not less than the predetermined level, the ink consumption calculated by the calculation means is made the threshold value. Thereby, thus obtained threshold value is used for a next determining process of the amount of remaining ink and therefore it is possible to correct the threshold value for determining the amount of remaining ink to be the value at the time that the sensing means detects a change from a state that the remaining amount is more than the predetermined level to a state that the remaining amount is equal to or less than the predetermined level.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now the embodiments of the present invention will be described in detail with reference to the accompanying drawings.

Embodiment 1

Figure 1:
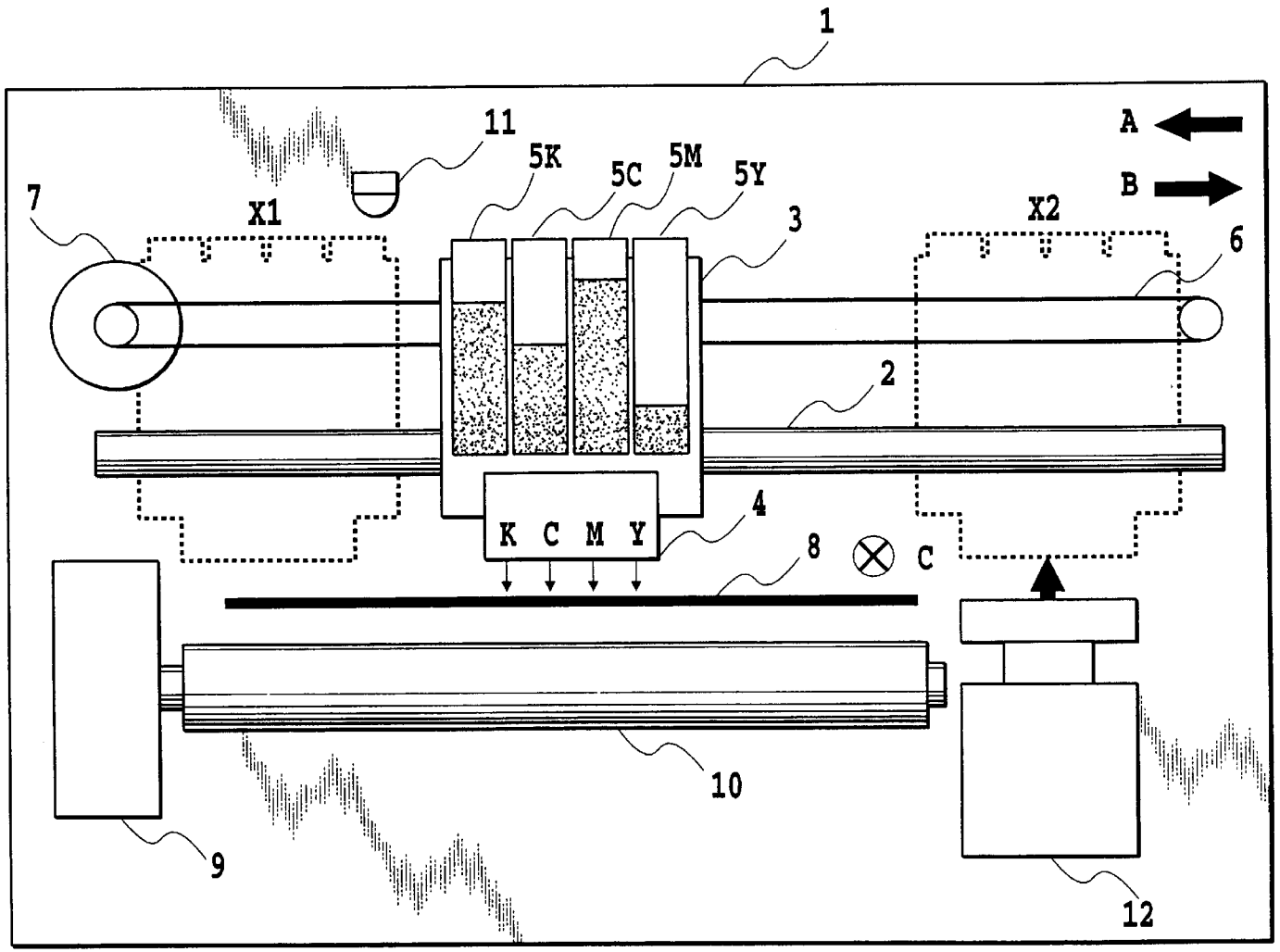
FIG. 1 is a front view schematically illustrating a general structure of an inkjet printer of an embodiment of the present invention.

FIG. 1 is a front view showing a schematic structure of an inkjet printer 1 in accordance with a first embodiment of the present invention.

In FIG. 1, a carriage 3, which can move in both directions shown by arrows A and B along a guide shaft 2, has thereon the printing head 4 equipped with array of nozzles that eject each black(K), cyan(C), magenta(M) and yellow(Y) ink respectively and ink tanks 5Y, 5M, 5C and 5K that store ink to be supplied to the printing head. The carriage 3 is driven by driving force of a carriage motor 7 that is transferred via a belt 6, which in part connects the carriage, to move in the both directions. The movement of carriage 3 allows the printing head 4 to be scanned to a printing medium 8 such as paper. During this scanning operation, driving pulses are given to an ejection heater installed for the individual nozzles of the printing heads 4, and then ink is ejected onto the medium to perform printing. More specifically, in the printing head of the embodiment, a driving pulse is applied to the ejection heater so as to generate thermal energy and a bubble is generated in ink by utilizing the thermal energy, and then ink is pushed out by the pressure of the bubble. At each time of scan by the printing head 4, the printing medium 8 is fed as much as a predetermined amount in the direction shown by arrow C (in the direction perpendicular to the drawing sheet) by a feeder roller 10 driven by a feeder motor 9. Repetition of these operations completes printing for one page of the printing medium 8.

At a position to which each of the ink tanks can face during the carriage 3 moves to a position shown by X1 in FIG. 1, a sensor 11 that will be described in FIG. 7 or latter for an optical detection of a remaining ink amount. Thereby, every time the carriage 3 has moved to the position X1 or the printing head 4 has moved to the position X1 during scanning, the sensor 11 detects the remaining ink amount in each ink tank. In the present embodiment, as described later in FIGS. 4 and 6, an output from the sensor 11 is taken at each scanning cycle of the printing head 4 and is used for a remaining ink data updating process that will be described later in FIG. 6. In the present embodiment, an optical sensor of relatively low-cost and simple-structure for checking whether the ink level has fallen below a predetermined amount or not (lack or not lack of ink) is used. However, aforementioned electric or mechanical sensors may also be employed instead of the optical sensor.

In a position X2 where the carriage 3 sits apart from the printing medium 8 in a direction shown by arrow B, the printing head 4 faces a recovery mechanism 12, which is provided for maintaining an ink ejection condition of the printing head 4 in a good condition. The recovery mechanism 12 includes caps, blades and the like to prevent ink from becoming more viscous in the nozzles by capping a whole nozzle face of the printing head during the period of conducting no printing. The recovery mechanism also performs a suction recovery operation in which ink is sucked out of the nozzle in a capped state so as to discharge viscous ink. Also, to these caps, the printing head eject ink as a preliminary ink ejection that is not directly involved in printing. Furthermore, it is possible to remove ink drops and dust by wiping the nozzle face with a blade prepared for each color and prevent the mixture of ink of different colors.

Figure 2:
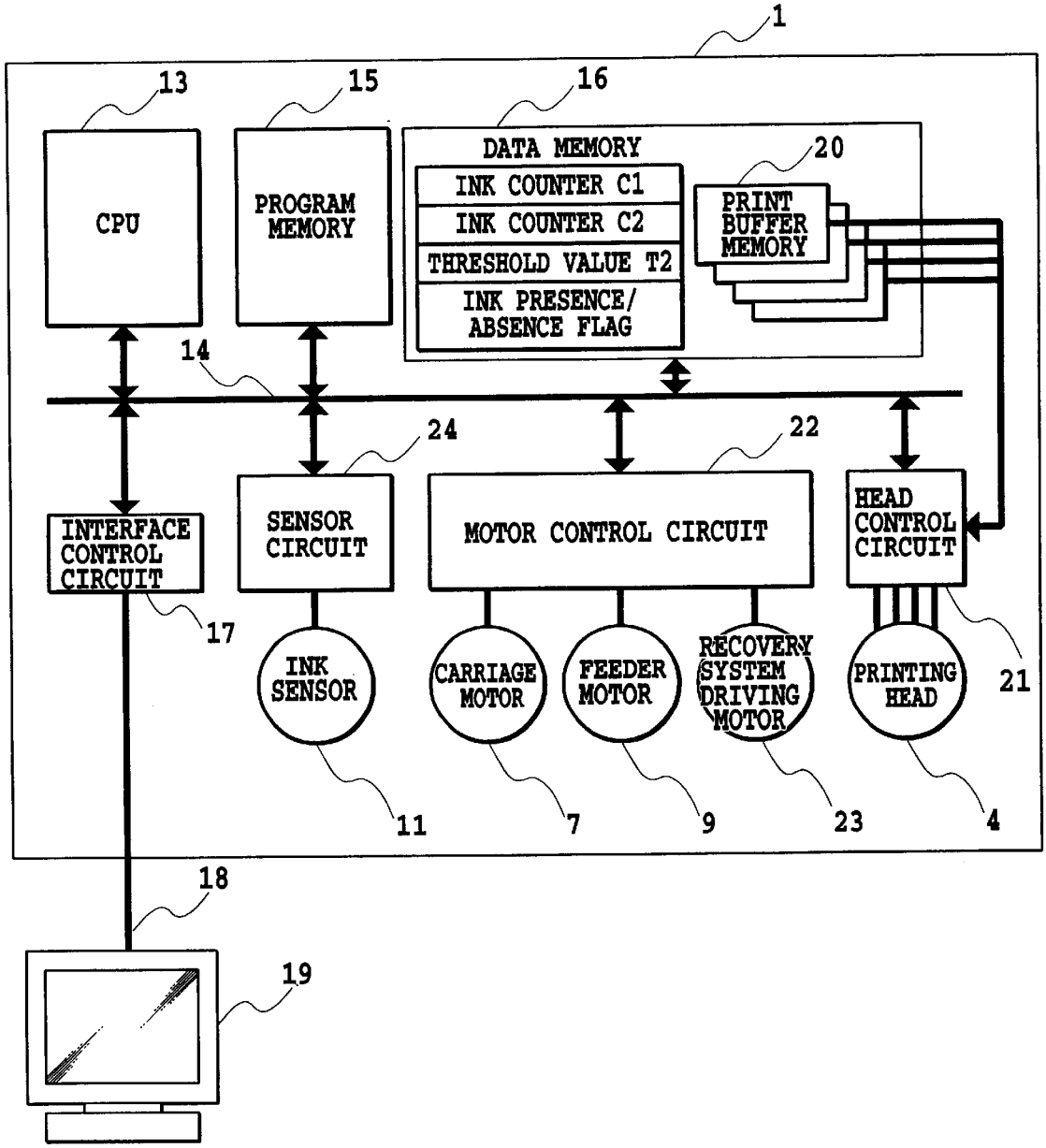
FIG. 2 is a block diagram showing a control configuration for the inkjet printer of FIG. 1.

FIG. 2 is a block diagram showing a structure of a control system for the inkjet printer shown in FIG. 1.

CPU 13 in a form of a micro processor unit operates based on a control program stored in a ROM program memory 15 and the information in a RAM data memory 16, which are connected to the CPU 13 via an internal bus 14.

The data memory 16 has regions for an ink counter C1 for each ink tank that counts ink consumption since a point in time when the remaining ink amount sensor 11 has detected an ink-out state (lack of ink) in the ink tank 5 and an ink counter C2 for each ink tank that counts ink consumption since a new ink tank 5 has been mounted. As described later in FIGS. 4 and 5, these counters counts an ink consumption due to ink ejection from the printing head during printing operation and the other ink consumption due to the suction recovery operation and the preliminary ejection operation, starting from the above mentioned point in time, respectively. Further, the data memory 16 also has a region for storing a threshold value T2 and a ink presence/absence flag F, which are, similarly to the counters C1 and C2, used in a processing described for FIG. 6. The threshold value T2 corresponds to the ink consumption that is supposed to be consumed since a new ink tank is mounted until the remaining sensor 11 detects the absence of ink in the ink tank, and the ink presence/absence flag F stores the latest detected result by the remaining sensor 11.

An interface control circuit 17 receives printing data sent from a host computer 19 via an interface cable 18 and the received data is distributed to be stored in printing buffer memories 20 for each color in the data memory 16. The printing image data stored in the printing buffer memories 20 is sent to the driver of the printing head 4 via a head control circuit 21.

Then the head control circuit 21 counts the number of ink droplets (hereafter, also referred to the number of ink dots) indicated by the printing image data sent to the printing head 4. Thereby, CPU 13 can get the number of ink dots of each color consumed for each scanning operation of the printing head by reading a register in the head control circuit 21. The value is translated into an amount of ink and then added to the data in the above counters C1 and C2.

CPU 13 controls the carriage motor 7, the feeder motor 9 and a recovery mechanism driving motor 23 via a motor control circuit 22. CPU 13 also reads an output from the optical sensor 11 via a sensor circuit 24 and detects the presence/absence of ink in each color tank 5.

Figure 6:
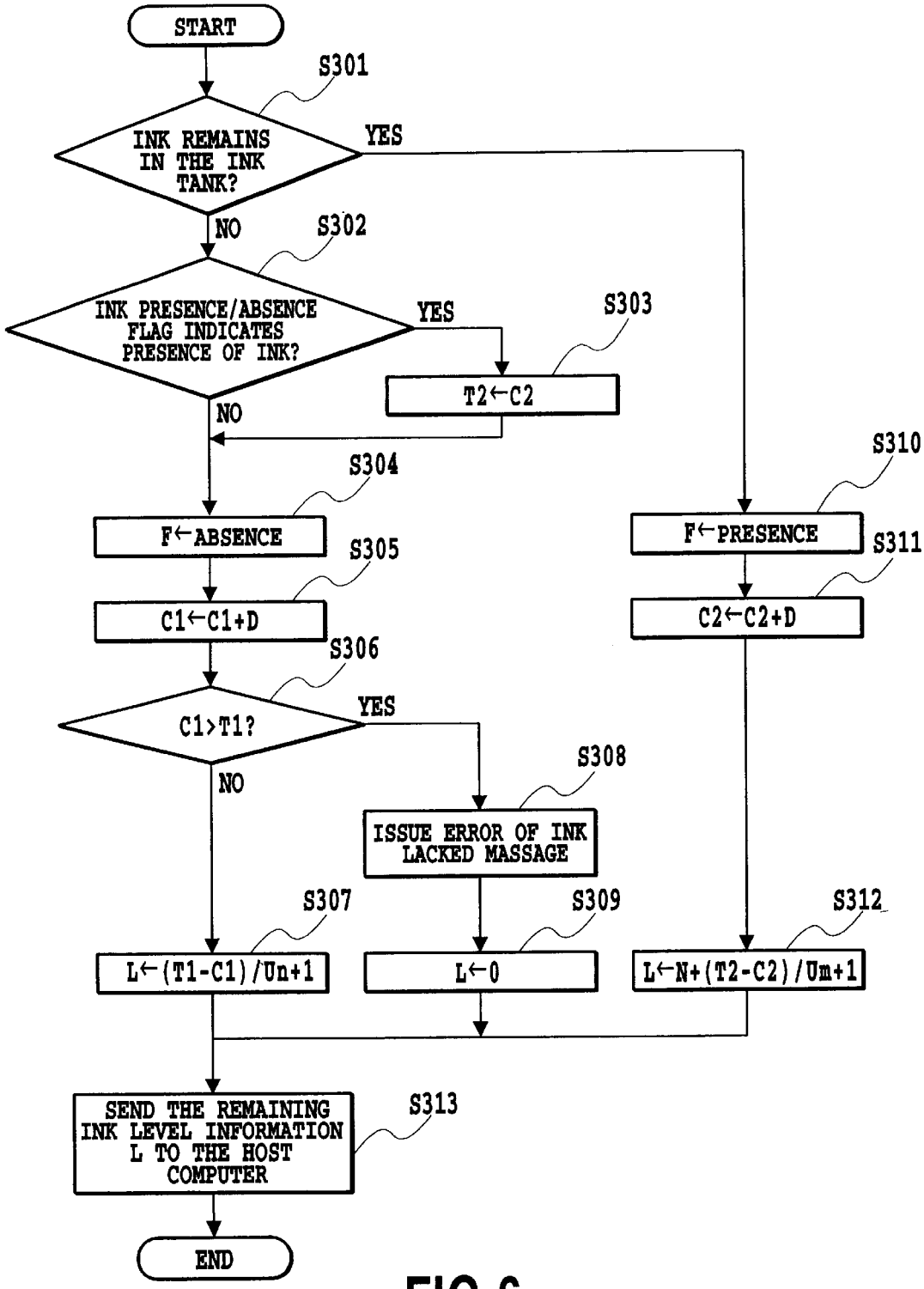
FIG. 6 is a flow chart showing process steps of updating data of remaining ink amounts in accordance with an embodiment of the invention.

The printer 1 can send information to the host computer 19 via the interface cable 18. Thus a remaining ink amount calculated in the printer 1, that is, a remaining ink level described later in FIG. 6, is sent to the host computer 19 to display the remaining ink level on the screen of the host computer 19.

Figure 3:
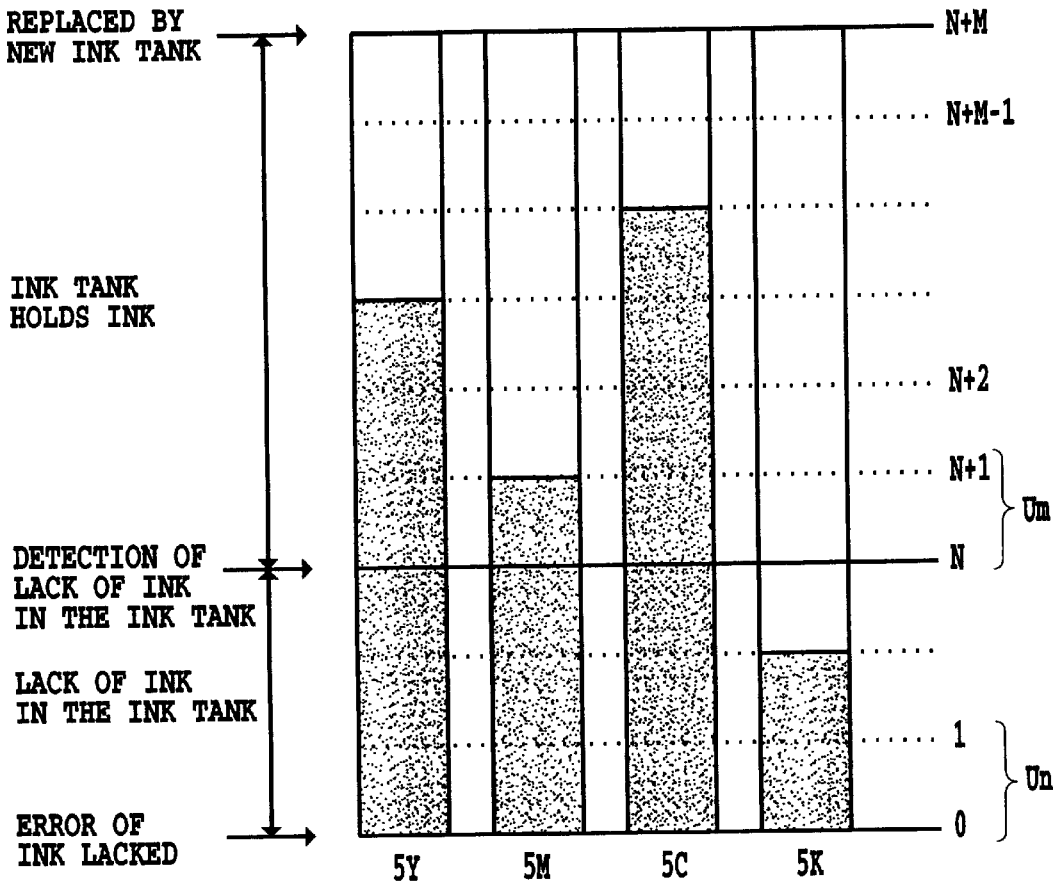
FIG. 3 is a diagram showing an indication manner of remaining ink amounts in accordance with an embodiment of the invention.

FIG. 3 shows how the remaining ink amount is displayed on the screen of the host computer 19 and is a diagram explaining the remaining ink level.

The remaining ink amounts in respective ink tanks 5Y, 5M, 5C and 5K are displayed in bar graphs as shown in the figure. As described later in FIG. 6, remaining level information L is calculated as remaining ink information in the printer and this information is sent to the host computer 19. Then the host computer 19 performs a display based on the remaining level information L, as shown in FIG. 3. Immediately after a new tank 5 has been mounted, the remaining ink level information L indicates to display an ink level corresponding to a level N+M in FIG. 3. At the point when the remaining sensor 11 has detected a lack of ink (absence of ink) in an ink tank 5, the remaining level information L primarily corresponds to level N in FIG. 3. This remaining level information L, however, may take in more than one value as explained later in FIG. 6 and accordingly indicates responding levels. Further, when the predetermined amount of ink has been consumed, an error of ink lacked is issued and then the remaining level information L corresponding to level 0 in FIG. 3 is displayed.

In the range between level N+M and level N in FIG. 3, the remaining level information is rounded to one of the M steps divided in equal intervals according to the value in remaining ink level information L. Unit interval Um showing a magnitude of one-step in the level indication represents a resolution for detection of the remaining levels, and is determined based on specs of the printer. This unit interval Um is also used in the calculation of the remaining level information L, as described later in FIG. 6. Similarly, the remaining level information between level N and level 0 is rounded to one of values equally divided into N steps. In addition, this unit interval Un is used in the calculation of the remaining level information L, as described later in FIG. 6.

Figure 4:
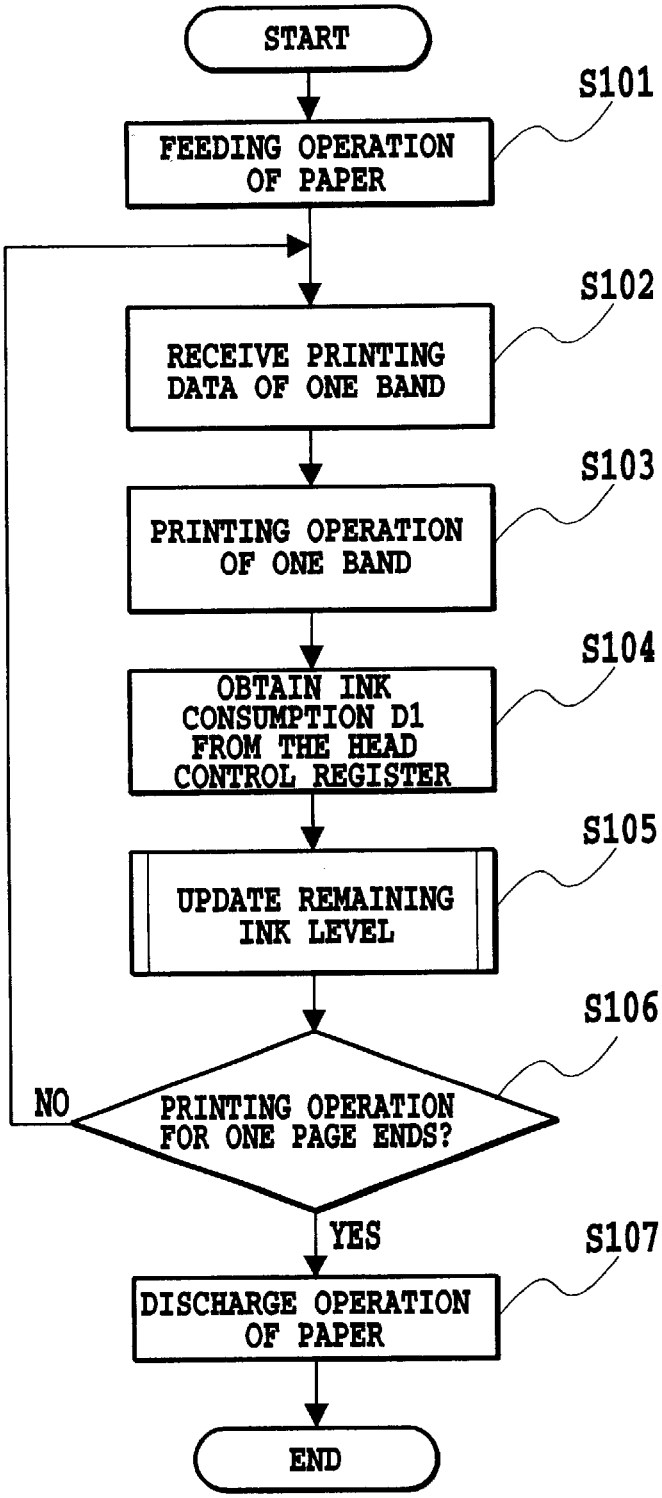
FIG. 4 is a flow chart showing process steps executed for a printing operation in the printer of FIG. 1.

FIG. 4 is a flow chart showing the procedure of the printing operation of the inkjet printer 1.

Before starting printing for one page, the inkjet printer 1 feeds a printing medium (paper sheet) in step S101. Next, the inkjet printing apparatus 1 receives printing data for one band or for one scanning of the printing head 4, from the host computer 19 in step S102, and performs printing for one band by scanning the printing head 4 in step S103.

During the printing operation, the inkjet printer 1 reads the register in the head control circuit 21, takes consumption D1 that is obtained by translating the number of ink dots consumed in the printing operation into ink amount in step S104, and updates the remaining level information in step S105, as described later in FIG. 6.

When printing for one page is completed in step S106 by repeating steps S101–S105, the printing medium is discharged in step S107 to end the printing operation and waits for the order of printing the next page.

Figure 5:
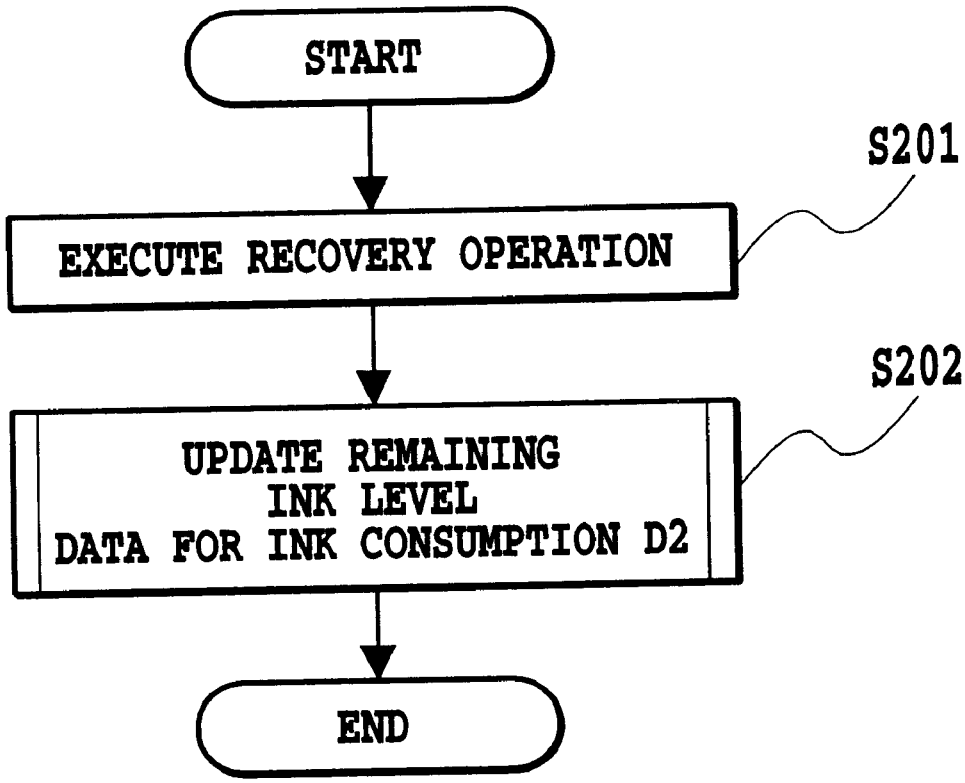
FIG. 5 is a flow chart showing process steps executed for a recovery operation in the printer of FIG. 1.

FIG. 5 is a flow chart showing a procedure of the recovery operation in the inkjet printer 1.

The inkjet printer 1 carries out the above-mentioned suction recovery operation and preliminary ejection in individual timings, for example, upon the start of printing operation and after predetermined times of printing, in step S201. The printer takes the amount of ink consumed in each of such recovery operations as an ink consumption D2 and, likewise the above printing operation, updates the remaining level information in step S202 to complete the process.

FIG. 6 is a flow chart showing a detailed procedure of steps S104 and S105 and step S202 for updating the remaining level information. This process is executed for each of ink tanks 5Y, 5M, 5C and 5K. In the following description, the process for only one ink tank will be explained but evidently this process can be applied to the other tanks.

First, the output from the remaining ink sensor 11 is taken to determine whether the ink in the ink tank 5 is absence or presence in step S301. In the case that the ink tank is detected to be in a state of lack of ink, in which the sensor 11 detects absence in the ink tank 5, the ink presence/absence flag F is checked to know whether a latest detection result of the sensor indicates the presence of ink in the ink tank 5 or not in step S302. When the ink presence/absence flag F is judged to indicate the detection state of the presence of ink, it is thought that an output of the sensor 11 first changes from the detection of the presence of ink into the detection of absence of ink. In this case, the value of the counter C2 is made stored as a content of the threshold value T2 in step S303. Thereby, the value of counter C2 can be made coincide with the threshold value T2. As a result, even if the value of the counter C2 includes an error due to variations in the ink consumption or the like between individual devices, the variations can be absorbed by the above correction to the threshold value T2, which is used for subsequent process, and then the remaining ink level L can be calculated accurately in subsequent step S312. At step S304, the ink presence/absence flag F is set to be a detection state of absence of ink when the flag F is judged to indicate the detection state of presence of ink mentioned above and the ink presence/absence flag F is kept to be as it is when the flag F is of detection state of absence of ink.

Next, the ink consumption D1 (D) relevant to the printing operation or the ink consumption D2 (D) relevant to the recovery operation is added to the ink counter C1 referred to in FIG. 2 in step S305. Then, in the following step for calculating the remaining level of ink, it is checked in step S306 if the value of the ink counter C1 exceeds a threshold value T1, which is used in the calculation of the remaining level after the state of lack of ink is detected for the ink tank 5. The threshold value T1 is an ink amount to be consumed since the sensor 11 has detected the lack of ink until an error of ink lacked, that is, is represented as N×Un using the level and the unit interval shown in FIG. 3. When the value of the ink counter C1 does not exceed the threshold value T1, the remaining level L is calculated as $$L=(T1-C1)/Un+1$$

in step S307. It should be noted that since such calculation is an integer-based calculation, the fractional portion is discarded in its division process. On the other hand, when the value of the ink counter C1 exceeds the threshold value T1, it sends an error of ink lacked to the host computer in step S308 and sets the remaining level L at zero in step S309.

On the other hand, When it is determined that the tank 5 still holds ink in step S301, the ink presence/absence flag F is set to be the detection state of presence of ink in step S310, and the ink consumption D1 (D) or D2 (D) is added to the counter C2 in step S311. Then, the remaining ink level L is calculated as $$L=N+(T2-C2)/Um+1$$

in step S312. Also this calculation is an integer-based calculation and the fractional portion is discarded in its division process.

Finally, any one of the remaining level L obtained in the procedure from step S301 to S312 is sent to the host computer 19 in step S313 to end this routine. Based on this information, the host computer 19 displays the remaining levels on the screen as shown in FIG. 3.

By performing the above processing, it becomes possible to indicate the remaining level of ink at discrete plural steps even with an inexpensive sensor 11 that only detects the presence/absence of ink in the ink tank 5. Further, even if variations in the ink consumption during operations caused by performance variations in the ejection quantity from the printing head and the recovery mechanism, and in the ink capacity of the ink tank 5 as well as the amount of filled ink, may cause errors in the estimate of the remaining levels, the remaining level is calculated with the threshold value corrected using the value of the counter C2 at a point in time when the sensor 11 has detected the lack of ink in the ink tank 5 and then, accurate detection of the remaining ink level can be realized despite presence of the error in the value of the counter.

Embodiment 2

In the above described embodiment, the value of the counter C2 at the time when the detection state for the ink tank is changed from the state of presence of ink into the state of absence of ink is stored as it is as the threshold value T2. However, respective values of the counter C2 at a plurality of times of changes of detection state may be stored as a record and used for calculation of an average or other calculation to obtain the threshold value T2 used for subsequent process, so that more effective detection of the amount of remaining ink can be executed.

FIGS. 7–12 are diagrams illustrating some examples of the specific structure of the optical ink amount sensor 11 used in the above embodiment.

Figure 7:
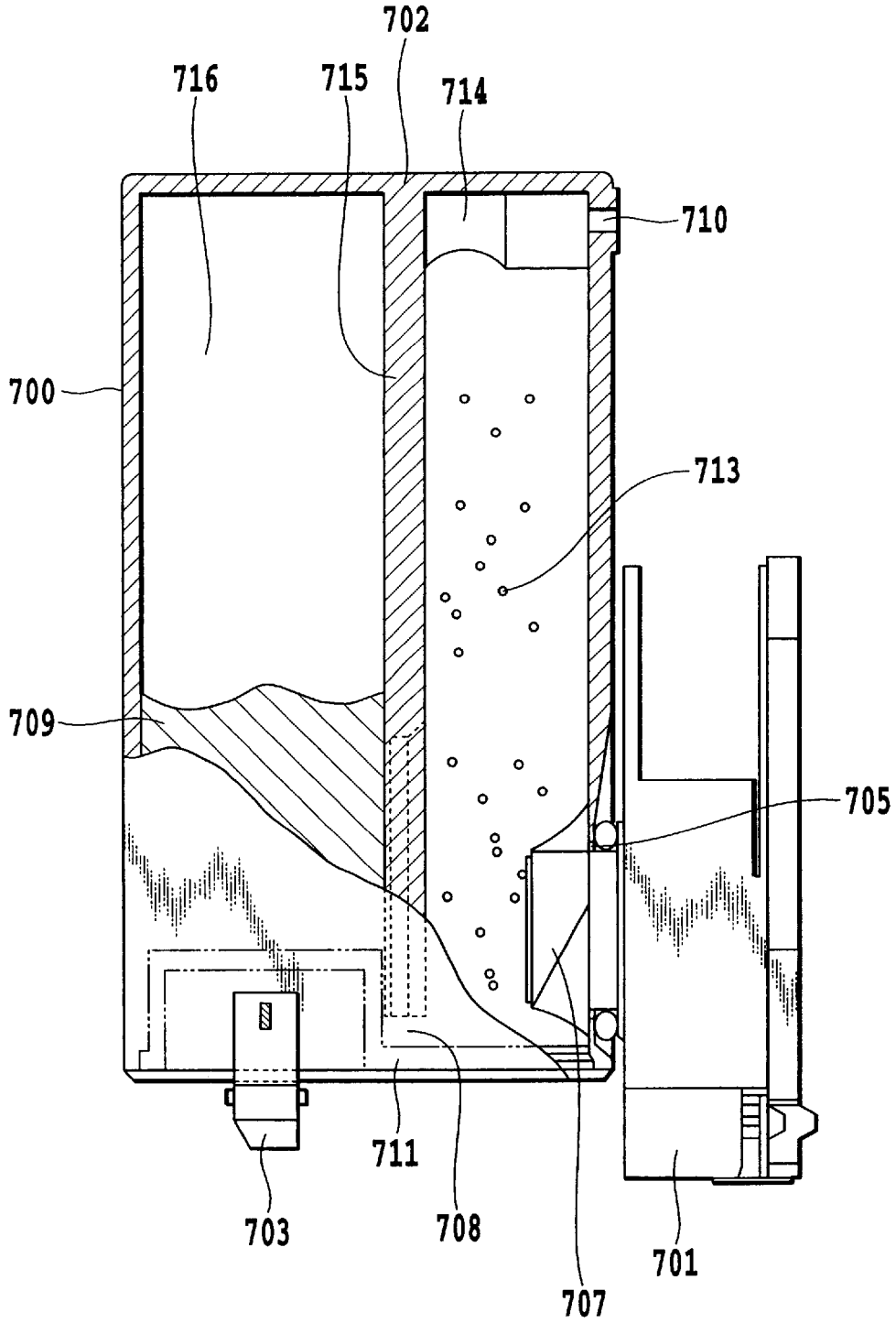
FIG. 7 is a view showing an example of a structure of an optical sensor detecting decrease in remaining ink amounts.

FIG. 7 shows a printing head 701 that ejects ink, an ink tank 700 that stores ink supplied to this printing head and a mechanism for detecting decrease in ink in the ink tank 700 with an optical sensor.

The ink tank 700 is divided by a rib 715 into a plurality of ink rooms. In the structure shown in FIG. 7, the plurality of ink rooms consist of an ink reservoir 716 that stores ink as it is and a negative-pressure generating material accommodating unit 714 that accommodates a negative-pressure generating material 713 made of a porous material like sponge or fibers. This ink reservoir 716 is linked to the negative-pressure generating material accommodating unit 714 via a gap 708 in the bottom 711 of the ink tank 700, so that the negative-pressure generating material 713 keeps a negative pressure in the unit to prevent the leak of ink accommodated in the negative-pressure creating material accommodating unit 714.

In FIG. 7, the ink room on the side of the negative-pressure generating material accommodating unit 714 of the replaceable ink tank 700 has an opening 705, where a joint 707 is inserted so that ink is supplied to the printing head 701 of the inkjet printer. The negative-pressure generating material accommodating unit 714 has an air communication hole 710 for communicating with the air.

During the printing operation in the inkjet printer, ink is ejected from the nozzles of the printing head 701, and then ink suction force is applied in the ink tank 700. The ink 709 ink tank 700, which is retained in the negative-pressure generating material 713, is firstly used a little, by the suction force. Then, the ink 709 in the ink tank 700 is drawn into the joint 707 from the ink reservoir 716 to the negative-pressure generating material accommodating unit 714 via the negative-pressure creating material 713 through the gap 708 between the end of the rib 715 and the bottom 711 of the ink cartridge, and eventually supplied to the printing head 701. Then, since the pressure in the ink reservoir 716 that is hermetically closed except in the gap 708 falls, a pressure difference is born between the ink reservoir 716 and the negative-pressure generating material accommodating unit 714. As printing continues, this pressure difference continues to grow. However, since the top of the negative-pressure generating material accommodating unit 714 leads to the air via the communication hole 710, air comes in the ink reservoir 716 thorough the gap 708 between the rib edge and the bottom 711 of the ink carriage via the negative-pressure generating material 713. At this point in time, the pressure difference between the ink reservoir 716 and the negative-pressure generating material accommodating unit 714 disappears. During the operation of the printing apparatus, this cycle is repeated and almost all the ink in the ink reservoir 716 is consumed except for that left on the walls inside the ink reservoir 716.

Figure 8:
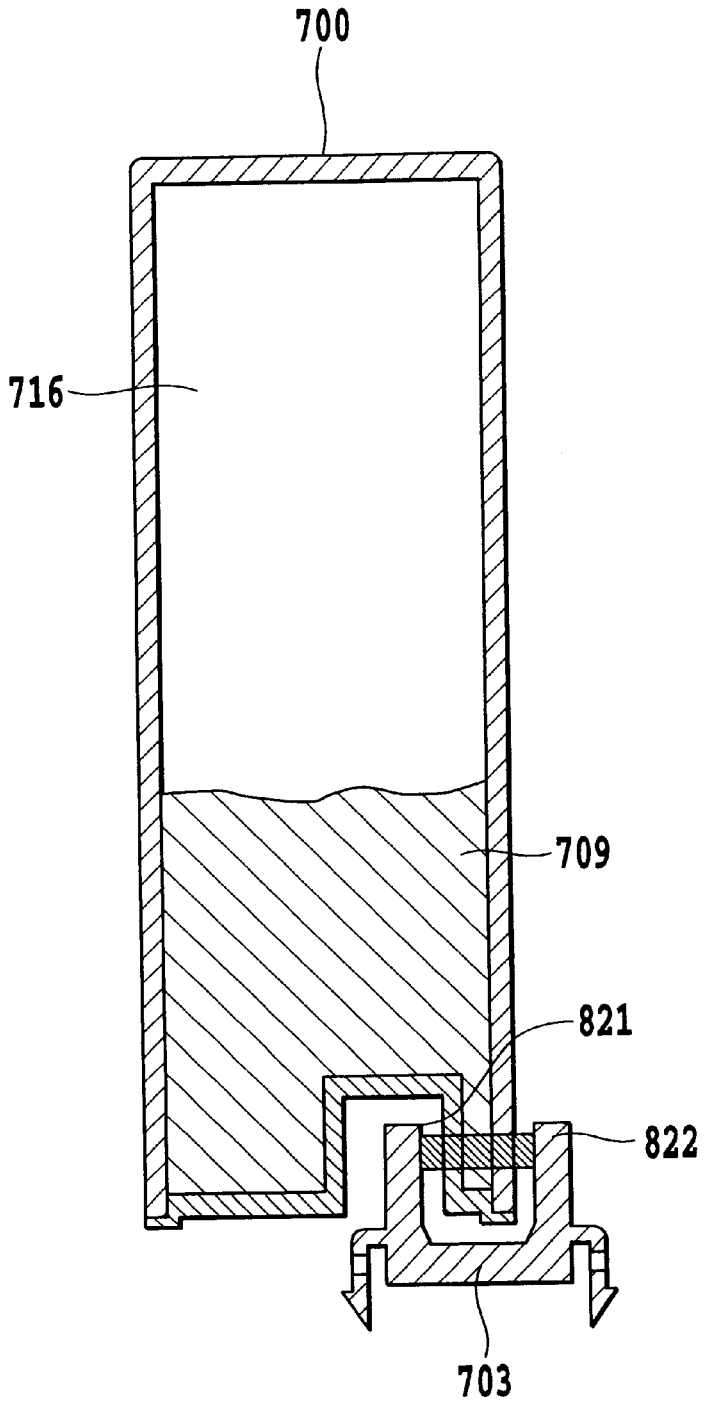
FIG. 8 is a view showing a detail of the optical sensor of FIG. 7.

As shown in FIGS. 7 and 8, an ink detection means 703 is installed in the printing apparatus on the bottom side of the ink tank 700 so as to check if the ink level in the ink reservoir 716 has fallen below the predetermined level. This ink detection means 703 comprises a light emitting device 821 that emits light onto the transparent part of the bottom of the ink reservoir 716 and a light receiving device 822 that receives the light in the position confronting the light emitting device. When the ink reservoir 716 is filled with ink 709, dye or pigment in ink 709 intercepts the light path and the light receiving device 822 provides no output signal. On the other hand, when the amount of ink 709 has decreased below the predetermined level in the ink reservoir 716, the light receiving device 822 provides an output indicating that it has received light. This output from the light receiving device indicates that the remaining level in the ink reservoir 716 has fallen below the predetermined level.

In the above manner, it becomes possible to know that the ink in the ink reservoir 716 of the ink tank 700 has almost run out, or that the ink level has fallen below the predetermined value.

Figure 9:
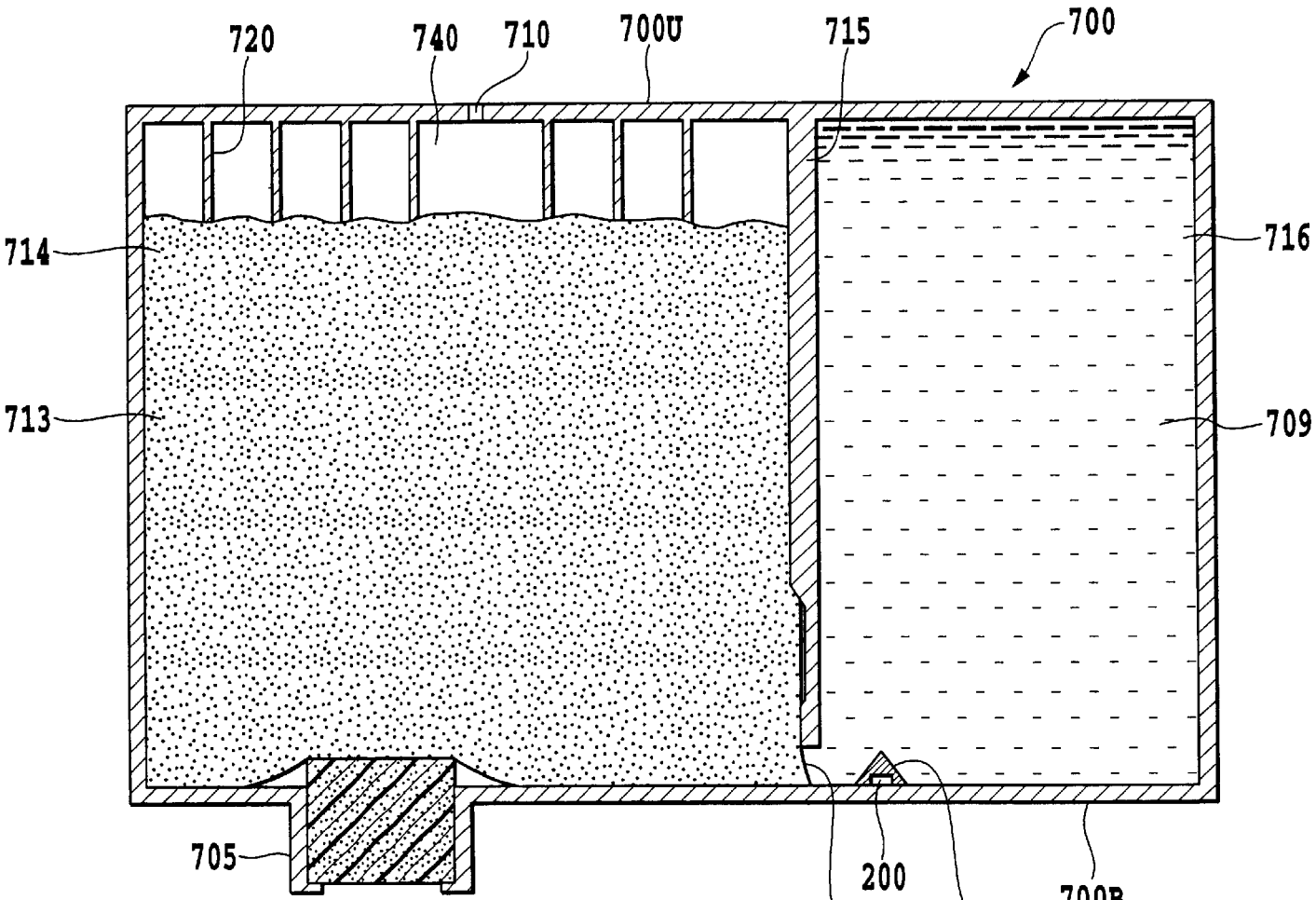
FIG. 9 is a view showing another structure of the optical sensor that detects the remaining ink amounts.

FIG. 9 is a diagram illustrating another example of the remaining level sensor.

In the structure shown in FIG. 7, the fall in remaining level in the ink reservoir 716 where ink is stored as it is in the ink tank 700 is checked by whether light passes or not, as shown in FIG. 8. In the structure shown below, a prism-like unit is installed in the bottom of the ink tank, and it is examined whether ink is left enough to contact this unit using the phenomenon of light reflection on the wall of the unit.

FIG. 9 is a side view illustrating the schematic structure of the ink tank 700. In FIG. 9, the components of the same or equivalent functions as those in FIG. 7 have the same reference signs.

The ink tank 700 of FIG. 9, much like that shown in FIG. 7, has a plurality of ink rooms separated by the rib 715. The negative-pressure generating material accommodating unit 714 accommodating the negative-pressure generating material 713 as an ink absorber is linked, in the bottom of the rib 715, with the ink reservoir 716 holding liquid ink as it is.

In the structure shown in FIG. 9, a plurality of ribs 720 inwardly protrude from the top side of the negative-pressure generating material accommodating unit 714 and contact the negative-pressure generating material 713 that is compressed and accommodated in a negative-pressure generating material accommodating unit 714. An air buffer room 740 is formed between the top wall 700U and the negative-pressure creating material 713.

A prism 180 is installed in the bottom 700B of the ink tank shown in FIG. 9 so as to detect the fall in the remaining ink level in the ink reservoir 716. The ink tank 700 is made of a semi-transparent material, for example, polypropylene, and the prism 180 is consolidated with the ink tank 700. The prism 180 has a triangle shape of which bottom face has a concave 200 in the center.

Figure 10:
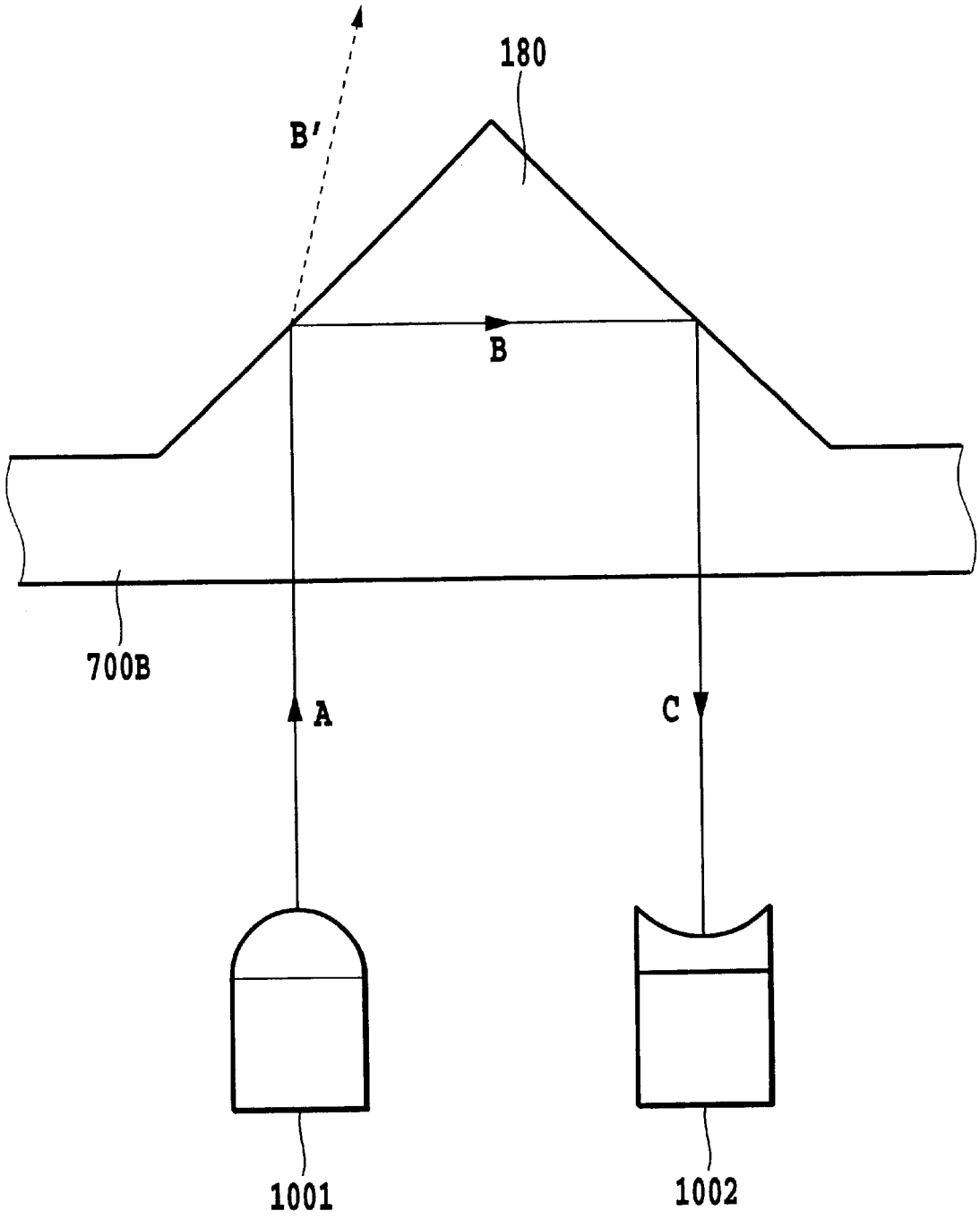
FIG. 10 is a diagram illustrating a function of a prism used in the optical sensor of FIG. 9.

Next, the detection principle using this prism 180 is explained with reference to FIG. 10. In FIG. 10, the concave 200 is not depicted.

FIG. 10 shows the relation between the transparent prism mounted on the bottom of the ink tank, a light emitting device 1001 that irradiates light onto the prism and a light receiving device 1002 that receives the light. Note that the light emitting device 1001 and the light receiving device 1002 are located on the side of the printing apparatus itself.

The prism 180 is consolidated with the bottom 700B of the ink tank 700, and the light emitted from the light emitting device 1001 enters the prism 180 from the bottom outside the ink tank 700.

The incident light proceeds along light paths A and B' into ink and is absorbed there when ink is filled in the ink reservoir 716 of the ink tank 700. On the other hand, when ink is consumed and absent in the ink reservoir 716, the incident light is reflected on the slope of the prism 180, as shown in FIG. 10, and reaches the light receiving device 1002 via light paths A, B and C. In this way, the intensity of light received by the light receiving device 1002 differs according to whether ink is present or absent in the ink reservoir 716. Thus it can be determined whether the remaining ink level has fallen below the predetermined value or not based on the output from the light receiving device 1002. Note that the condition of light reflection on the slope of the prism 180 depends on the refractivity indices of the material of the prism 180, ink and air. When ink is consumed and there is no contact with the slope, the light is totally reflected on the slope and thus the light receiving device 1002 receives strong light. In turn, when ink is left enough to contact the slope, the difference in refractivity between the material of the prism 180 and ink is small and thus there is no total reflection on the slope. Then the light proceeds into the ink reservoir 716.

In the above manner, it becomes possible to know that the ink in the ink reservoir 716 of the ink tank 700 has almost run out, or that the ink level has fallen below the predetermined value.

Figure 11:
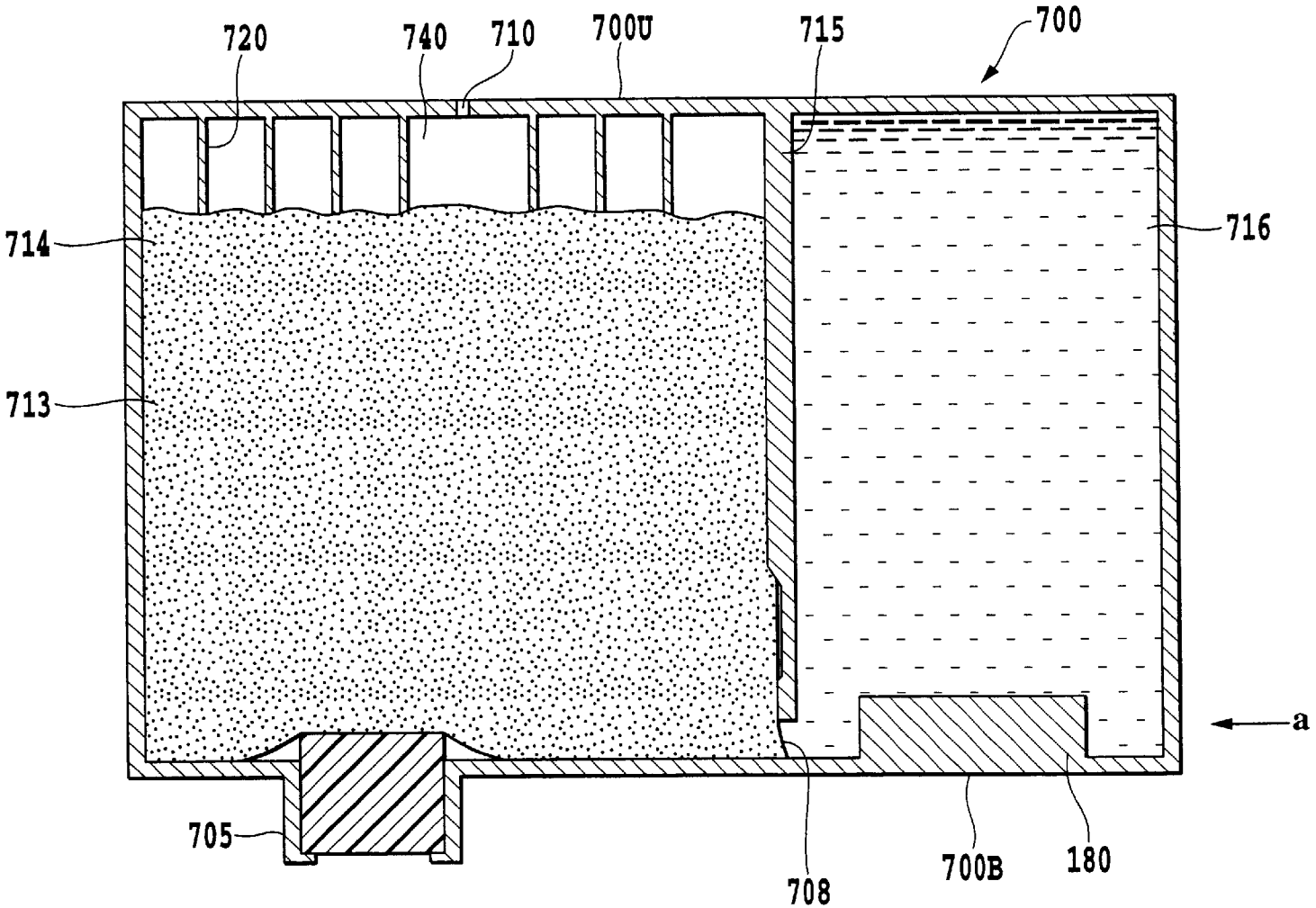
FIG. 11 is a view showing another structure of the optical sensor that detects the remaining ink amounts.

FIG. 11 shows a structure having a prism 180 in the ink reservoir 716 of the ink tank 700, like FIG. 9. The same components as those in FIG. 9 have the same symbols.

Figure 12:
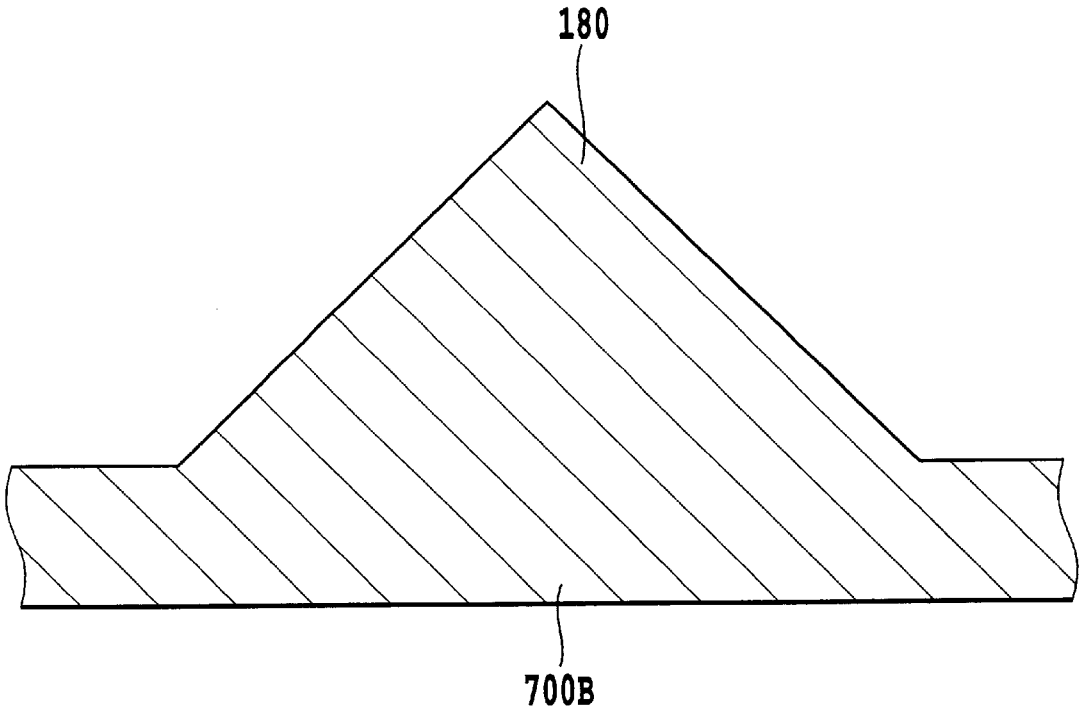
FIG. 12 is an enlarged view of the prism of FIG. 11 viewed from a direction indicated by arrow a in FIG. 11.

The difference from FIG. 9 is the direction of the prism 180 installed in the ink reservoir 716. FIG. 12 is an enlarged view of the prism 180 viewed from the direction indicated by arrow a in FIG. 11.

As shown in FIG. 11, in the printing apparatus using the ink tank 700 having the prism 180, the aforementioned light emitting device and light receiving device are installed in the positions facing the installed prism 180.

In the structure shown in FIG. 11, the prism 180 has slopes of a large area and thus, compared with the structure of FIG. 9, the irradiated light can be precisely captured in the slopes of the prism.

As described above, according to the embodiments of the present invention, in determining a remaining amount of ink, when the sensing means detects that the remaining amount is equal to or less than a predetermined level and the state stored in the detection condition memory means indicates a state that the remaining amount is not equal to or not less than the predetermined level, the ink consumption calculated by the calculation means is made the threshold value. Thereby, thus obtained threshold value is used for a next determining process of the amount of remaining ink and therefore it is possible to correct the threshold value for determining the amount of remaining ink to be the value at the time that the sensing means detects a change from a state that the remaining amount is more than the predetermined level to a state that the remaining amount is equal to or less than the predetermined level.

As a result, it becomes possible to detect the remaining level in detailed scales despite an error in calculation of the amount of remaining ink, while using a relatively inexpensive sensor that only determines whether the remaining level is below a predetermined value or not.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A remaining amount detecting method of detecting an amount of remaining ink in an ink reservoir, comprising the steps of:

providing sensing means for detecting whether the amount of remaining ink in the reservoir is below a predetermined level or not, detection state memory means for storing a state that said sensing means detects that the amount of remaining ink is below the predetermined level or a state that the amount of remaining ink is not below the predetermined level, and calculation means for calculating ink consumption in the ink reservoir based on an operation of means using the ink; and determining the amount of remaining ink on the predetermined level basis by using an ink consumption calculated by said calculation means and a threshold value as the ink consumption that is calculated by said calculation means and then supposed to reach the predetermined level for said sensing means;

wherein when said sensing means detects that the amount is below the predetermined level and the detection state stored in said detection state memory means is that the amount of remaining ink is not below the predetermined level, the ink consumption calculated by said calculation means is made a content of the threshold value.

2. A remaining amount detecting method as claimed in claim 1, wherein the amount of remaining ink determined by using the ink consumption calculated by said calculation means and the threshold value is determined as each of remaining ink levels of plural steps.

3. A remaining amount detecting method as claimed in claim 1, further comprising a step of displaying the determined amount of remaining ink.

4. A remaining amount detecting method as claimed in claim 1, wherein the means using the ink is an inkjet printing apparatus and ink is consumed by a printing operation of a printing head ejecting ink in the apparatus and by a recovery operation for the printing head.

5. An inkjet printing apparatus using a printing head for ejecting ink and an ink reservoir for storing ink supplied to the printing head to perform printing on a printing medium, and detecting an amount of remaining ink in the ink reservoir, said apparatus comprising:

sensing means for detecting whether the amount of remaining ink in the reservoir is below a predetermined level or not;

detection state memory means for storing a state that said sensing means detects that the amount of remaining ink is below the predetermined level or a state that the amount of remaining ink is not below the predetermined level;

calculation means for calculating ink consumption in the ink reservoir based on an operation of means using the ink; and determining the amount of remaining ink on the predetermined level basis by using an ink consumption calculated by said calculation means and a threshold value as the ink consumption that is calculated by said calculation means and then supposed to reach the predetermined level for said sensing means;

wherein when said sensing means detects that the amount is below the predetermined level and the detection state stored in said detection state memory means is that the amount of remaining ink is not below the predetermined level, the ink consumption calculated by said calculation means is made a content of the threshold value.

6. An inkjet printing apparatus as claimed in claim 5, wherein the amount of remaining ink determined by using the ink consumption calculated by said calculation means and the threshold value is determined as each of remaining ink levels of plural steps.

7. An inkjet printing apparatus as claimed in claim 5, wherein the means using the ink is an inkjet printing apparatus and ink is consumed by a printing operation of a printing head ejecting ink in the apparatus and by a recovery operation for the printing head.

8. An inkjet printing apparatus as claimed in claim 5, further comprising means for sending information of the determined amount of remaining ink to a host device of said inkjet printing apparatus.

9. An inkjet printing apparatus as claimed in claim 5, wherein the printing head generates a bubble in ink utilizing thermal energy and ejects ink by pressure of the bubble.

10. A remaining amount detecting method, for an inkjet printing apparatus comprising an optical sensor detecting a presence or an absence of ink in an ink reservoir, ink consumption calculation means for calculating ink consumption during operations including printing and a first counter that accumulates the ink consumption calculated by said ink consumption calculation means since said optical sensor has detected the absence of ink in the ink reservoir, previously setting the ink consumption since said optical sensor has detected the absence of ink in the ink reservoir until an error of ink lacked as a first threshold value, accumulating the ink consumption calculated by said ink consumption calculation means in said first ink counter since said optical sensor has detected the absence of ink in the ink reservoir, and issuing the error of lacked ink when the first ink counter exceeds the first threshold; said method comprising the steps of:

providing a second ink counter that accumulates the ink consumption calculated by said ink consumption calculation means since a new ink reservoir has been mounted, first remaining ink level calculation means for calculating a first remaining ink level that can be consumed until the error of ink lacked based on a value in said first ink counter when said optical sensor has detected the absence of ink in the ink reservoir, second remaining ink level calculation means for calculating a second remaining ink level that is expected to be consumed until the error of ink lacked based on a value in said second ink counter when said optical sensor has detected the presence of ink in the ink reservoir, remaining ink level determining means for determining a remaining ink level by selecting either the first remaining ink level or the second remaining ink level based on a state of the optical sensor and by making a predetermined correction, and remaining ink level display means for displaying the remaining ink level determined by said remaining ink level determining means, setting an amount of ink that is expected to be consumed since the new ink reservoir has been mounted until said optical sensor has detected the absence of ink in the ink reservoir as a second threshold value, setting the remaining ink level that should be taken in when the new ink reservoir has been mounted as a first remaining ink level, setting the remaining ink level that should be taken in when said optical sensor has detected the absence of ink in the ink reservoir as a second remaining ink level, and setting the remaining ink level that should be taken in upon the error of ink lacked as a third remaining ink level;

wherein said first remaining ink level calculation means calculates the first remaining ink level so that the first remaining ink level becomes the second remaining ink level when the optical sensor has detected the absence of ink in the ink reservoir and becomes the third remaining ink level when the first ink counter has reached the first threshold value, said second remaining ink level calculation means calculates the second remaining ink level so that the second remaining ink level becomes the first remaining ink level when a new ink reservoir has been mounted and becomes the second remaining ink level when the second ink counter has reached the second threshold value, and said remaining ink level determining means selects the first remaining ink level calculated by said first remaining ink level calculation means when the optical sensor has detected the absence of ink in the ink reservoir, selects the second remaining ink level calculated by the second remaining ink level calculation means when the optical sensor has detected the presence of ink in the ink reservoir, and stores the value of the second counter at the time when a state that the optical sensor detects the presence of ink is changed to a state that the optical sensor detects the absence of ink, as a record, and said second threshold determining means determines the second threshold value corrected based on the value of the second counter stored as the record.

11. A remaining amount detecting method as claimed in claim 10, wherein said second threshold determining means determines a latest value stored in the second counter, as the second threshold value.

12. A remaining amount detecting method as claimed in claim 10, wherein said second threshold determining means determines an average value of a plurality of values stored in the second counter, as the second threshold value.

13. A remaining amount detecting method as claimed in claim 10, wherein said remaining ink level determining means determines only ink levels divided into N levels between the first remaining ink level and the second remaining ink levels and into M levels between the second remaining ink level and the third remaining ink level.

14. A remaining amount detecting method as claimed in claim 10, further comprising step of displaying the remaining ink level determined by said remaining ink level determining means.

15. An inkjet printing apparatus comprising an optical sensor detecting a presence or an absence of ink in an ink reservoir, ink consumption calculation means for calculating ink consumption during operations including printing and a first counter that accumulates the ink consumption calculated by said ink consumption calculation means since said optical sensor has detected the absence of ink in the ink reservoir, previously setting the ink consumption since said optical sensor has detected the absence of ink in the ink reservoir until an error of ink lacked as a first threshold value, accumulating the ink consumption calculated by said ink consumption calculation means in said first ink counter since said optical sensor has detected the absence of ink in the ink reservoir, and issuing the error of lacked ink when the first ink counter exceeds the first threshold; said apparatus comprising:

a second ink counter that accumulates the ink consumption calculated by said ink consumption calculation means since a new ink reservoir has been mounted;

first remaining ink level calculation means for calculating a first remaining ink level that can be consumed until the error of ink lacked based on a value in said first ink counter when said optical sensor has detected the absence of ink in the ink reservoir;

second remaining ink level calculation means for calculating a second remaining ink level that is expected to be consumed until the error of ink lacked based on a value in said second ink counter when said optical sensor has detected the presence of ink in the ink reservoir;

remaining ink level determining means for determining a remaining ink level by selecting either the first remaining ink level or the second remaining ink level based on a state of the optical sensor and by making a predetermined correction; and remaining ink level display means for displaying the remaining ink level determined by said remaining ink level determining means, setting an amount of ink that is expected to be consumed since the new ink reservoir has been mounted until said optical sensor has detected the absence of ink in the ink reservoir as a second threshold value, setting the remaining ink level that should be taken in when the new ink reservoir has been mounted as a first remaining ink level, setting the remaining ink level that should be taken in when said optical sensor has detected the absence of ink in the ink reservoir as a second remaining ink level, and setting the remaining ink level that should be taken in upon the error of ink lacked as a third remaining ink level;

wherein said first remaining ink level calculation means calculates the first remaining ink level so that the first remaining ink level becomes the second remaining ink level when the optical sensor has detected the absence of ink in the ink reservoir and becomes the third remaining ink level when the first ink counter has reached the first threshold value, said second remaining ink level calculation means calculates the second remaining ink level so that the second remaining ink level becomes the first remaining ink level when a new ink reservoir has been mounted and becomes the second remaining ink level when the second ink counter has reached the second threshold value, and said remaining ink level determining means selects the first remaining ink level calculated by said first remaining ink level calculation means when the optical sensor has detected the absence of ink in the ink reservoir, selects the second remaining ink level calculated by the second remaining ink level calculation means when the optical sensor has detected the presence of ink in the ink reservoir, and stores the value of the second counter at the time when a state that the optical sensor detects the presence of ink is changed to a state that the optical sensor detects the absence of ink, as a record, and said second threshold determining means determines the second threshold value corrected based on the value of the second counter stored as the record.

16. An inkjet printing apparatus as claimed in claim 15, wherein said second threshold determining means determines a latest value stored in the second counter, as the second threshold value.

17. An inkjet printing apparatus as claimed in claim 15, wherein said second threshold determining means determines an average value of a plurality of values stored in the second counter, as the second threshold value.

18. An inkjet printing apparatus as claimed in claim 15, wherein said remaining ink level determining means determines only ink levels divided into N levels between the first remaining ink level and the second remaining ink levels and into M levels between the second remaining ink level and the third remaining ink level.

19. An inkjet printing apparatus as claimed in claim 15, wherein said inkjet printing apparatus and a host computer form an inkjet printing system, said inkjet printing apparatus further comprises means for sending the remaining ink level information to the host computer, and the host computer comprises means for receiving the remaining ink level information from said inkjet printing apparatus and displays the remaining ink level on a screen thereof.

* * * * *

UNITED STATES PATENT AND TRADEMARK OFFICE

CERTIFICATE OF CORRECTION

PATENT NO. : 6,648,436 B2
DATED : November 18, 2003
INVENTOR(S) : Masao Maeda

It is certified that error appears in the above-identified patent and that said Letters Patent is hereby corrected as shown below:

Title page,
Item [57], ABSTRACT,
Line 10, “detect” should read -- detected --.

Drawings,
In Figure 6, “MASSAGE” should read -- MESSAGE --.

Column 4,
Line 57, “a ink” should read -- an ink --.

Column 5,
Line 7, “to” should read -- to as --.

Column 6,
Line 28, “absence” should read -- absent --;
Line 29, “presence” shouold read -- present --;
Line 39, “made” should be deleted; and
Line 41, “coincide” should read -- to coincide --.

Column 8,
Line 13, “in” should read -- in ink --; and
Line 28, “thorough” should read -- through --.

Column 12,
Line 31, “means,” should read -- means; and --.

Column 13,
Line 18, “levels” should read -- level --;
Line 59, “and” should be deleted; and
Line 62, “means,” should read -- means; and --.

UNITED STATES PATENT AND TRADEMARK OFFICE

CERTIFICATE OF CORRECTION

PATENT NO. : 6,648,436 B2
DATED : November 18, 2003
INVENTOR(S) : Masao Maeda

It is certified that error appears in the above-identified patent and that said Letters Patent is hereby corrected as shown below:

Column 14,
Line 52, “levels” should read -- level. --.

Signed and Sealed this

Seventeenth Day of August, 2004

JON W. DUDAS
*Acting Director of the United States Patent and Trademark Office*